US005970301A

United States Patent [19]

De Cock

[11] Patent Number: 5,970,301

[45] Date of Patent: Oct. 19, 1999

[54] DEVICE AND METHOD FIXING AND GLOSSING TONER IMAGES

[75] Inventor: Etienne Marie De Cock, Edegem, Belgium

[73] Assignee: Xeikon N.V., Mortsel, Belgium

[21] Appl. No.: 09/195,741

[22] Filed: Nov. 19, 1998

Related U.S. Application Data

[60] Provisional application No. 60/067,664, Dec. 5, 1997.

[30] Foreign Application Priority Data

Dec. 3, 1997 [EP] European Pat. Off. ..... 97309760

[51] Int. Cl.[6] ..... G03G 15/20

[52] U.S. Cl. ..... 399/341; 399/328; 399/335; 430/126

[58] Field of Search ..... 399/341, 328, 399/329, 335, 338, 406; 430/124, 126; 219/216

[56] References Cited

U.S. PATENT DOCUMENTS

| | | | |
|---|---|---|---|
| 3,449,546 | 6/1969 | Dhoble | 219/216 |
| 3,948,215 | 4/1976 | Namiki | 118/60 |
| 5,001,031 | 3/1991 | Yamamoto et al. | 430/109 |
| 5,119,142 | 6/1992 | Swapceinski et al. | 399/331 |
| 5,250,998 | 10/1993 | Ueda et al. | 399/329 |
| 5,278,618 | 1/1994 | Mitani et al. | 399/329 |
| 5,319,429 | 6/1994 | Fukuchi et al. . | |
| 5,321,480 | 6/1994 | Merle et al. | 399/329 |
| 5,386,281 | 1/1995 | Mitani et al. . | |
| 5,465,146 | 11/1995 | Higashi et al. | 399/328 |
| 5,483,331 | 1/1996 | Wayman et al. . | |
| 5,521,688 | 5/1996 | Moser . | |
| 5,526,108 | 6/1996 | Billet et al. . | |
| 5,758,245 | 5/1998 | Matsuura et al. | 399/329 |
| 5,805,969 | 9/1998 | Elsermans et al. | 399/341 |
| 5,893,666 | 4/1999 | Aslam et al. | 399/329 |
| 5,897,249 | 4/1999 | Aslam et al. | 399/329 |

FOREIGN PATENT DOCUMENTS

| | | |
|---|---|---|
| 0758766 | 2/1997 | European Pat. Off. . |
| 0848304 | 6/1998 | European Pat. Off. . |
| 2-190870 | 7/1990 | Japan . |
| 4-195079 | 7/1992 | Japan . |
| 10-207256 | 8/1998 | Japan . |
| 2014325 | 8/1979 | United Kingdom . |

OTHER PUBLICATIONS

Patent Abstracts of Japan, abstract of published document 63–193155, publication date Aug. 10, 1988.

*Primary Examiner*—Matthew S. Smith
*Attorney, Agent, or Firm*—Baker & Botts, L.L.P.

[57] ABSTRACT

A substrate carrying an unfixed toner image is fed through a contact zone which extends continuously from an entrance to an exit (18; 78). The zone is defined by an endless surface such as a first belt and a reaction surface such as a second belt in face-to-face pressure contact therewith. The first belt adjacent the entrance is heated to a temperature sufficient to reduce the viscosity of the toner to less than 50 Pa s. The first belt is forcibly cooled intermediate the entrance and the exit to a temperature below the glass transition point $T_g$ of the toner. Thereby un-fixed toner images can be fixed to the substrate and provided with a desirable level of gloss in one single device, while widening the range of operating conditions without risk of offset occurring.

13 Claims, 3 Drawing Sheets

DEVICE AND METHOD FIXING AND GLOSSING TONER IMAGES

This application claims the benefit of U.S. Provisional application Ser. No. 60/067664, filed Dec. 5, 1997.

FIELD OF THE INVENTION

This invention is concerned with the fixing of toner images on a substrate in an electrostatographic printer or copier. More particularly, it is concerned with the fixing of powder toner images obtained via electrophotographic, electrographic, ionographic or magnetic recording processes in which an electrostatic or magnetographic latent image is rendered visible by the deposition of a suitable toner composition on the latent image.

BACKGROUND OF THE INVENTION

In present day copying machines or electronic printer devices, the fixing or permanent adherence of a toner image on a substrate in the form of a sheet is often carried out with a so-called hot roller or nip-roller fixing system. This image-fixing device comprises a pair of rollers through the nip of which a sheet carrying a toner image is fed. The surface of the roller contacting the toner image is heated above the softening temperature of the toner resin, which becomes tacky or molten and forms a permanent bond with the surface of the sheet. The roller, contacting the toner image, is provided with a coating having abhesive (i.e. non-adhesive) properties versus the toner image. In order to increase the non-adhesive characteristics of the roller surface, use is often made of silicone oil. The rollers forming the image-fixing unit are pressed against each other. The roller contacting the backside of the sheet is generally covered with a silicone elastomer, capable of resisting the heat generated by the image-fixing roller.

Problems arise with hot roller image-fixing devices. In particular, in heavy duty printers where long periods between servicing are usual, it is difficult to maintain a constant image-fixing quality and a long roller lifetime.

A technique known as "flash-fixing" is also known in which a short intense burst of radiant energy is applied to the substrate carrying the toner image to be fixed. The wavelength of the radiant energy is chosen to be absorbed by the toner. Such a technique is unsuitable for multi-color images, where toners of different composition are carried on the substrate, said toners having different absorption characteristics in the spectrum.

A number of constructions of image fixing devices using infra-red radiant fixing have been proposed in the art. U.S. Pat. No. 3,449,546 (Dhoble/Xerox Corporation) describes a xerographic fusing apparatus, which is capable of heating toner powder to its glass transition point without damaging the paper support material, wherein the paper acts as a heat source to aid in the fusing process. U.S. Pat. No. 5,526,108 (Billet et al/Xeikon NV) describes a radiant fixing device comprising at least one radiant source, the peak energy output wavelength of which lies in the non-visible part of the spectrum.

Infra-red fixing devices however cause a loss of moisture from the substrate, as a result of the high temperature to which the substrate is heated, i.e. the substrate becomes too dry. This loss of moisture can result in deformation of the substrate and the low moisture level can result in the generation and retention of electrostatic charges on the substrate, both of which effects can produce problems in subsequent handling of the substrate.

A number of proposals have been made for fixing toner images by the use of a belt.

In U.S. Pat. No. 3,948,215 (Namiki/Ricoh Co., Ltd) a toner image on a support sheet is fused either by disposing the sheet in with a heating surface or by additionally pressing the sheet. After the toner particles are fused, the sheet is cooled while maintaining its image bearing side in contact with the surface previously used for heating, so that the particles solidify and the toner image is stiffened. Pressure may be applied to the support sheet as it contacts the heating surface.

U.S. Pat. No. 5,483,331 (Wayman et al./Xerox Corporation) describes a transfer and fusing belt arrangement in which three fuser rollers cooperate with a pressure roller to form an extended fusing zone through which an electrically resistive substrate carrying toner images passes, with the toner images contacting the fusing belt. Electrical power is applied to the three fuser rollers so that only the portions between these rollers are heated.

U.S. Pat. No. 5,386,281 (Mitani et al./Hitachi Koki Co. Ltd) describes a thermal fixing device including a metal belt press contacted to a pressing roller. A heating device is associated with the belt. An image support carrying an unfixed toner image is passed through the nip between the roller and the belt so that the image is thermally fixed. The belt is also associated with a cooling device which cools the image support beyond the nip so that the image support can be stripped from the metal belt.

European patent application EP 0848304 (Xeikon NV), published Jun. 17, 1998, discloses a fixing device which comprises a belt in face-to-face contact with a reaction surface to form an extended contact zone therebetween. A substrate, carrying an unfixed toner particle image, is passed through the contact zone. The belt is heated adjacent the entrance to the contact zone to a temperature above the softening point of the toner. The belt is forcibly cooled intermediate the entrance and the exit to a temperature below the softening point of the toner. Pressure rollers apply pressure between the belt and the reaction surface intermediate the entrance and the exit. The belt is also heated adjacent the exit.

EP 0848304 also discloses an embodiment in which an unfixed toner particle image is transferred to a substrate in the contact zone. In the case of such transfer, it is recommended that the surface of the image should contact the substrate above the "fluid temperature", so as to ensure mixing of the toner particles of different colors. The "fluid temperature" is defined as the temperature at which the viscosity of the toner falls below 50 Pa s.

Due to the fact that dry toner images have a high thickness (sometimes more than 10 $\mu$m), the appearance of such images is sometimes unnatural and non-uniform and these images usually have a non-uniform color saturation. While this appearance is acceptable for many applications, it is sometimes desired to provide an image having a different appearance or finish. By the term "finish" in the context of the present invention, we mean either a surface characteristic which is glossy, i.e. highly reflective, and/or which provides high saturation of colors, this usually being achieved by reducing the scattering of light from the surface of the printed article, or both such characteristics. A higher degree of color saturation can be very desirable in high quality print work.

It has been proposed to provide glossy images by the use of a toner which incorporates a glossing agent, or by the application of a transparent glossing layer over the toner image. However, these methods are costly in terms of consumables.

In U.S. Pat. No. 5,521,688 (Moser/Xerox Corporation) it has been proposed to provide glossy images by passing the substrate carrying the toner images through an oven heater to fix the images and then through a pair of glossing rollers operating at approximately the same temperature as the oven.

U.S. Pat. No. 5,319,429 (Fukuchi et al./Konica Corporation) describes a color printer having a fixer for fixing a toner image on a recording sheet, which includes an endless polyimide heat belt which is supported by a heat roller and a separation roller, and an endless conveyance belt which is supported by a pressure roller and another separation roller. The endless heat belt and the conveyance belt are pressed together over part of their length, so that a nip region is created between the first pair of rollers and the second pair. The belts have glossy surfaces. It is recommended in U.S. Pat. No. 5,319,429 that the most appropriate fixing condition can be obtained when the viscosity of the toner is about 5000 poise (=500 Pa s).

European patent application EP 0758766 (Xeikon NV) discloses an electrostatographic printer in which a web of receiving material, after passing through a fixing device, is contacted with a finishing element while at a temperature above the glass transition temperature of the toner to modify the finish of the toner image.

It would be desirable to use one and the same device to fix the toner images and to provide them with the desired gloss. However, contact-less fixing devices are unable to provide a uniform glossing effect, while we have found that the use of known heated rollers or heated belt fixing devices suffer from toner offset problems and do not provide sufficient control over the gloss and color saturation of the images. In particular such known devices exhibit limited process parameters, with a narrow window of optimum performance.

It is an object of the present invention to provide a device and method whereby un-fixed toner images can be fixed to a substrate and provided with a desirable level of gloss in one single device, while widening the range of operating conditions without risk of offset occurring.

SUMMARY OF THE INVENTION

We have found that this, any other useful objectives can be achieved by the use of a belt or other endless surface fuser having a contact zone through which the substrate passes, the endless surface being heated adjacent the entrance of the contact zone to a temperature sufficient to reduce the viscosity of the toner to less than 50 Pa s and cooled within the contact zone.

Thus, according to the invention, there is provided a method of fixing an unfixed toner particle image on a substrate, comprising:

feeding a substrate carrying an unfixed toner image through a contact zone which extends continuously from an entrance to an exit thereof and is defined by an endless surface and a reaction surface in face-to-face pressure contact with the endless surface;

heating the endless surface adjacent the entrance to a temperature above the glass transition point $T_g$ of the toner; and forcibly cooling the endless surface intermediate the entrance and the exit to a temperature below the glass transition point $T_g$ of the toner, characterized in that the endless surface adjacent the entrance is heated to a temperature sufficient to reduce the viscosity of the toner to less than 50 Pa s.

While not wishing to be bound by theory, we believe that, where toner images are fixed on a substrate by means of a heated surface such as a roller or heated belt, there is a risk of molten toner becoming transferred to the heated surface as the substrate separates therefrom, to be subsequently deposited on a following section of substrate, resulting in the phenomenon of "ghost images". Even if the characteristics of the heated surface are so chosen as to reduce the risk of such "hot-offset", the separation of the heated surface from the substrate tends to distort the toner particles into a somewhat non-flat shape, leading to low gloss and color saturation. Forcibly cooling the substrate on the other hand, while pressure is applied thereto, tends to flatten the toner particles, leading to an increase in color saturation or alternatively enabling the quantity of toner used during printing to be reduced by, for example, 20% to 30%. Thus, it is essential according to the invention to cool the endless surface to a temperature below the glass transition point $T_g$ of the toner while the endless surface is in pressure contact with the reaction surface. There is therefore a temperature gradient within the contact zone, from a temperature sufficient to reduce the viscosity of the toner to less than 50 Pa s adjacent the entrance of the contact zone to a temperature below the glass transition point $T_g$ of the toner before the exit from the zone.

In this invention, the toner carried on the substrate is heated to a temperature sufficient to reduce the viscosity thereof to less than 50 Pa s. This temperature is also referred to herein as the fluid temperature, $T_f$. Ideally, the toner carried on the substrate is heated to a temperature sufficient to reduce the viscosity thereof to between 10 Pa s and 40 Pa s. The fluid temperature of the toner is above the glass transition temperature and is typically above 150° C., even above 200° C., depending upon the composition of the toner. Preferably, the toner is not heated above its degradation temperature, that is the temperature at which irreversible changes occur in the toner composition leading to a significant change in its spectral properties. Viscosity is typically measured by the use of a cup viscometer (Ford cup, Shell cup or Zahn cup). ASTM D-1200 is an accepted standard for the measurement of viscosities of printing inks. Laray and Churchill falling rod viscometers may also be used.

In a first preferred embodiment of the invention, pressure is applied between the endless surface and the reaction surface intermediate the entrance and the exit. The invention thus also provides a device for fixing an unfixed toner particle image on a substrate, comprising an endless surface, a reaction surface in face-to-face pressure contact with the endless surface to form a contact zone therebetween, extending continuously from an entrance to an exit, means for feeding a substrate carrying an unfixed toner image through the contact zone from the entrance to the exit, heating means for heating the endless surface adjacent the entrance, and cooling means for forcibly cooling the endless surface intermediate the entrance and the exit to a temperature below the glass transition point $T_g$ of the toner characterized in that the heating means is capable of heating the endless surface adjacent the entrance to a temperature sufficient to reduce the viscosity of the toner to less than 50 Pa s, and by means for applying pressure between the endless surface and the reaction surface intermediate the entrance and exit.

The endless surface will generally be the surface of a belt, although it is also possible for the endless surface to be constituted by the surface of a drum. As used in the following general description, the term "belt" is intended to embrace other forms of endless surface, such as a drum, except where the context demands otherwise.

The heating means may comprise a heating surface in contact with the belt, such as a roller, or a heated stationary body over which the belt passes. Heating may be achieved, for example, by passing a heating fluid (e.g. steam or hot oil) at an elevated temperature through the roller or stationary body, or by the provision of radiant heating means positioned within the roller or stationary body. It is also possible to use radiant heating means for directly heating the belt, and this may be especially beneficial where the belt is formed primarily of heat non-conductive material. Generally, the belt will be heated from the side thereof opposite to its contact with the reaction surface and the substrate. Generally, the belt contacts the substrate with a dry surface, i.e. there is no need to apply a liquid release agent to the belt surface.

In a second preferred embodiment of the invention, the endless surface is heated adjacent the exit of the contact zone to a temperature above the glass transition point $T_g$ of the toner, but most preferably not above the fluid temperature $T_f$. The invention thus also provides a device for fixing an unfixed toner particle image on a substrate, comprising an endless surface, a reaction surface in face-to-face pressure contact with the endless surface to form a contact zone therebetween, extending continuously from an entrance to an exit, means for feeding a substrate carrying an unfixed toner image through the contact zone from the entrance to the exit, heating means for heating the endless surface adjacent the entrance, and cooling means for forcibly cooling the endless surface intermediate the entrance and the exit to a temperature below the glass transition point $T_g$ of the toner characterized in that the heating means is capable of heating the endless surface adjacent the entrance to a temperature sufficient to reduce the viscosity of the toner to less than 50 Pa s, and by second heating means for heating the endless surface adjacent the exit to a temperature above the glass transition point $T_g$ of the toner.

The advantage of this second heating is to raise the temperature of the flattened surface of the toner, thereby lowering its surface energy. This eases the release of the toner from the belt, without raising the temperature of the bulk of the toner so much that the toner loses its flatness as it separates from the belt or even breaks down leaving toner deposited on the belt. The second heating means may be constructed in a similar manner to the heating means at the entrance to the contact zone, for example as a second heated roller over which the belt passes. Where second heating means in the form of a second heated roller is provided adjacent the exit of the contact zone, it is preferable to arrange the geometry such that the belt wraps partially around the second heated roller within the contact zone, to enhance the heating effect thereof.

Preferably both intermediate pressure and second heating are used together to gain maximum advantage from the invention.

The cooling means may comprise a cooling surface in contact with the belt, such as a cooling roller over which the belt passes. Cooling may be achieved, for example, by passing a cooling fluid (e.g. water at room temperature or reduced temperature) through the roller or stationary body. It is also possible to direct cold or cooled air directly at the belt. Generally, the belt will be cooled from the side thereof opposite to its contact with the reaction surface and the substrate.

The heat extracted from the belt by the cooling means may be used to pre-heat the belt on its return run, in advance of the heating which takes place at the entrance to the contact zone. Thus, the cooling means may be constituted by the cold region of a heat pump, the hot region of which is in contact with the belt on its return run.

The belt may comprise a heat conductive backing carrying a coating of non-adhesive material, preferably a silicone rubber. In any event, the belt should have a low thermal capacity, to ensure the rapid heating and cooling thereof. Such rapid temperature changes enable the apparatus to be smaller in size than would otherwise be necessary. The belt should also be formed primarily of a heat conductive material, if heating from the "back-side" thereof is to be used. A heat-conductive belt has the advantage of distributing a more even temperature, as "hot spots" are avoided. The belt, or at least the coating carried thereon, should be seamless, especially if substrates in web-form are to be used.

Even though the substrate temperature rises in the contact zone, even to above 100° C., it is preferable that any moisture in the substrate cannot escape but condenses on the belt to be returned to the substrate by the second heating means. The disadvantages of open radiant fixing referred to above, resulting from the substrate becoming too dry, would therefore be avoided. Loss of moisture in the substrate may be reduced by the use of an impermeable endless surface and an impermeable reaction surface. Thus both the belt and the reaction surface are preferably impermeable.

The reaction surface may be constituted by a further belt. This is especially useful where a toner particle image is carried on both faces of the substrate (i.e. a "duplex" substrate). In this embodiment, further heating means may be provided for heating the further belt adjacent the entrance to a temperature sufficient to reduce the viscosity of the toner to less than 50 Pa s, and further cooling means may be provided for forcibly cooling the further belt intermediate the entrance and the exit to a temperature below the glass transition point $T_g$ of the toner. Alternatively, the reaction surface may be constituted by a surface of a stationary body, which may include means for cooling the stationary body.

Alternatively, the toner particle image may be carried on one face only of the substrate (i.e. a "simplex" substrate). For example, the substrate may comprise adhesive labels carried on a plastics material backing sheet. For such "simplex" substrates, the reaction surface may be constituted by either a further belt or by a stationary body. Where a further belt is used as the reaction surface for "simplex" substrates, it need not be heated at all. Indeed, forcibly cooling the further belt, even from the entrance of the contact zone, helps to avoid distortion of the substrate.

The contact zone extends from the initial point of contact between the belt and its reaction surface to the point of separation between the belt and its reaction surface. It is important to maintain contact within the contact zone, although the pressure need not be constant throughout the zone. The pressure may be generated by virtue of the geometry of the belt and its reaction surface, but it is helpful to provide a pair of intermediate pressure rollers located one on either side of the contact zone, upstream of the cooling means. The pressure which is applied intermediate the entrance and exit of the contact zone is preferably applied at the same region as, or immediately before, the region of application of the forced cooling. It is also preferred to apply pressure between the belt and the reaction surface adjacent the entrance to the contact zone. Thus, in the contact zone at least two pressure points are realized, one adjacent the entrance and the other intermediate the entrance and the exit. We have found that an average contact pressure at the pressure points of between 2 to 20 $N/cm^2$, such as from 5 to 10 $N/cm^2$ is preferred, depending on the absorbency of the substrate, the temperature and the viscosity of the toner at that temperature.

Where the cooling means and the further cooling means are both constituted by cooling rollers, these cooling rollers should be so positioned as to ensure more than tangential contact between each cooling roller and its associated belt. By ensuring that each belt partially wraps around its associated cooling roller, the forcible cooling effect is thereby obtained.

The substrate may be in the form of a web, but the invention is equally applicable to substrates in sheet form, the device then being provided with suitable sheet feeding means. The geometry of the device may be such as to define a substantially straight path for the substrate. This can be of advantage for heavier, especially thicker or less flexible, substrates.

The belt, and the further belt where present, may be driven directly, for example by applying drive to a heating roller at the entrance of the contact zone, to a second heating roller at the exit of the contact zone or to an intermediate pressure roller. It is important to arrange for the belt to be driven in synchronism with movement of the substrate, and with the further belt where present, to prevent slippage which may distort the toner image. Alternatively, where the substrate is in the form of a web, the belt, and the further belt where present, may be driven by movement of the web itself, means being provided to compensate for the torque resistance of the belt(s). This arrangement ensures that the substrate web and the belt(s) move in synchronism.

The belt may return from the exit of the contact zone to the entrance thereof via an adjustable tensioning and alignment roller. Where an intermediate pressure roller is in contact with the belt within the contact zone, this intermediate pressure roller may be in heat exchange relationship with the alignment roller, for example by way of a heat exchange fluid passing through hollow interiors of both rollers. The energy requirements of the device can thereby be reduced.

The device according to the invention may be part of a printer, advantageously an electrostatographic printer, having at least one imaging station, where a latent image is formed upon a rotatable endless surface member such as an electrostatically chargeable photoconductive drum or belt and an array of image-wise modulated light-emitting diodes is used as an exposure source. The latent image is then developed at a toner development station to form a toner image on the surface member. The toner image is transferred at a toner transfer station from the surface member onto a moving substrate, or onto a moving transfer member for later transfer to a substrate. The printer may also be equipped with cutting means in order to cut the printed web into sheets. The cutting means is preferably positioned downstream of the fixing device.

The development station uses a developer which contains toner particles containing a mixture of a resin, a dye or pigment of the appropriate color and normally a charge-controlling compound giving triboelectric charge to the toner. In dual-component developers which are normally used, carrier particles are also present for charging the toner particles by frictional contact therewith. The carrier particles may be made of a magnetizable material, such as iron or iron oxide. Developing technologies other than magnetic brush development, such as mono-component developers, can be used.

Dry-development toners essentially comprise a thermoplastic binder consisting of a thermoplastic resin or mixture of resins including coloring matter, e.g. carbon black or coloring material such as finely dispersed pigments or dyes.

The mean diameter of dry toner particles for use in magnetic brush development is conventionally about 10 $\mu$m (ref. "Principles of Non Impact Printing" by Jerome L. Johnson—Palatino Press Irvine Calif., 92715 U.S.A. (1986), p. 64–85). For high resolution development, the mean diameter may be from 1 to 5 $\mu$m (see e.g. British patent specification GB-A-2180948 and International patent specification WO-A-91/00548).

The toner particles contain in the resinous binder one or more colorants (dissolved dye or dispersed pigment) which may be white or black or has a color of the visible spectrum, not excluding however the presence of infra-red or ultraviolet absorbing substances.

The thermoplastic resinous binder may be formed of polyester, polyethylene, polystyrene and copolymers thereof, e.g. styrene-acrylic resin, styrene-butadiene resin, acrylate and methacrylate resins, polyvinyl chloride resin, vinyl acetate resin, copoly(vinyl chloride-vinyl acetate) resin, copoly(vinyl chloride-vinyl acetate-maleic acid) resin, vinyl butyral resins, polyvinyl alcohol resins, polyurethane resins, polyimide resins, polyamide resins and polyester resins. Polyester resins are preferred for providing high gloss and improved abrasion resistance. Such resins usually have a glass transition point $T_g$ of more than 54° C. with a melt viscosity of at least 50 Pas up to no more than 1500 Pas. The presence of other ingredients in the toner particles, such as the colorant, usually have no significant effect upon the glass transition temperature. The volume resistivity of the resins is preferably at least $10^{13}$ Ω-cm.

Suitable toner compositions are described in European patent applications EP-A-601235, and EP-A-628883 and International patent applications WO 94/27192, 94/27191 and 94/29770 (all Agfa-Gevaert NV). The glass transition points of most common toner compositions are similar at about 60° C. The typical fixing temperature has hitherto been therefore about 120° C.

Where the substrate carries a number of different toners, as for example in the case of multi-color images, the belt should raise the temperature to above the lowest fluid temperature of the toners present, most preferably above the highest fluid temperature of the toners present, so as to ensure mixing of the toner particles of different colors and the fixing of the image on the substrate.

We prefer to use toners having a composition comprising a thermoplastic binder and from 10% to 50% by weight, based on the weight of the toner composition, of a pigment. We also prefer that the toner composition in powder form has a weight average particle size of between 0.5 $\mu$m and 5 $\mu$m, preferably between 1 $\mu$m and 4 $\mu$m. The use of toner compositions having a higher level of pigment therein enables images with a higher density to be printed. Alternatively, for the same image density, smaller toner particles can then be used. The use of smaller toner particles has the advantage that the height of the toner image above the surface of the substrate is lower. The advantages of a lower toner image height include (a) irregularities in the surface of the substrate have less of an effect upon the gloss of the image, (b) the total usage of toner is reduced—this is important because the cost of the toner may be significant in the total cost of the printed product, (c) the tendency of the printed page to curl is reduced, (d) the stacking of printed pages, for example in the preparation of a book, is more even, and (e) there is a flatter feel to the printed page, a characteristic which is of advantage to some users.

The printer may be a color printer, containing a plurality of imaging stations each associated with a development and transfer station and the image-fixing station is located downstream of the last toner transfer station before cutting the printed web. In one embodiment of such a color printer, the development stations contain respectively cyan, magenta, yellow and optionally black toner particles.

The web of substrate may be fed through the printer from a roll. If desired, the substrate may be conditioned (i.e. its moisture content adjusted to an optimum level for printing), prior to entering the printer.

The printer according to the invention may be a duplex color printer which includes two sets of imaging, development and transfer stations, one set at each side of the web. The invention is however equally applicable for use with a printer intended for simplex (i.e. one-sided) printing.

The device according to the invention may also be part of an electrostatic copier, working on similar principles to those described above in connection with electrostatic printers. In copiers however, it is common to expose the rotatable endless surface member by optical means, directly from the original image to be copied.

BRIEF DESCRIPTION OF THE DRAWING

The invention will be described in further detail, purely by way of example, with reference to the accompanying drawings, in which.

DETAILED DESCRIPTION

Figure 1:
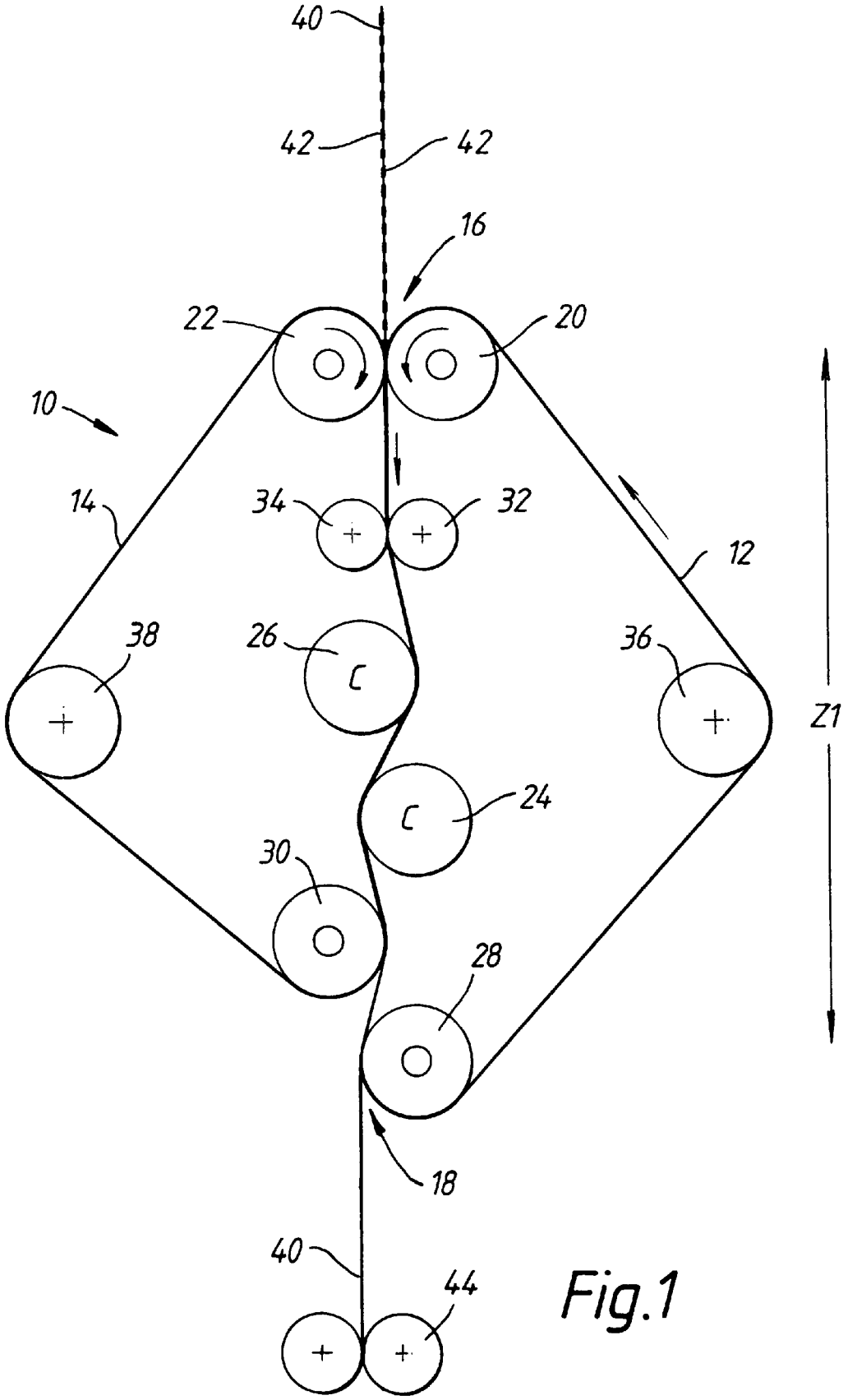
FIG. 1 shows a fixing device according to the invention, for fixing toner images carried on both faces of a substrate in the form of a web.
Figure 2A:
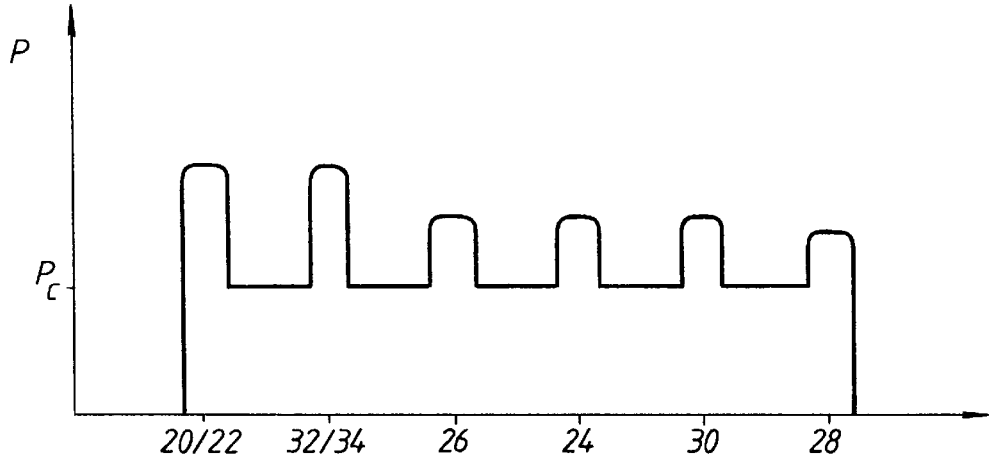
FIG. 2 shows charts plotting pressure and temperature against the position of the substrate in the device according to FIG. 1.
Figure 2B:
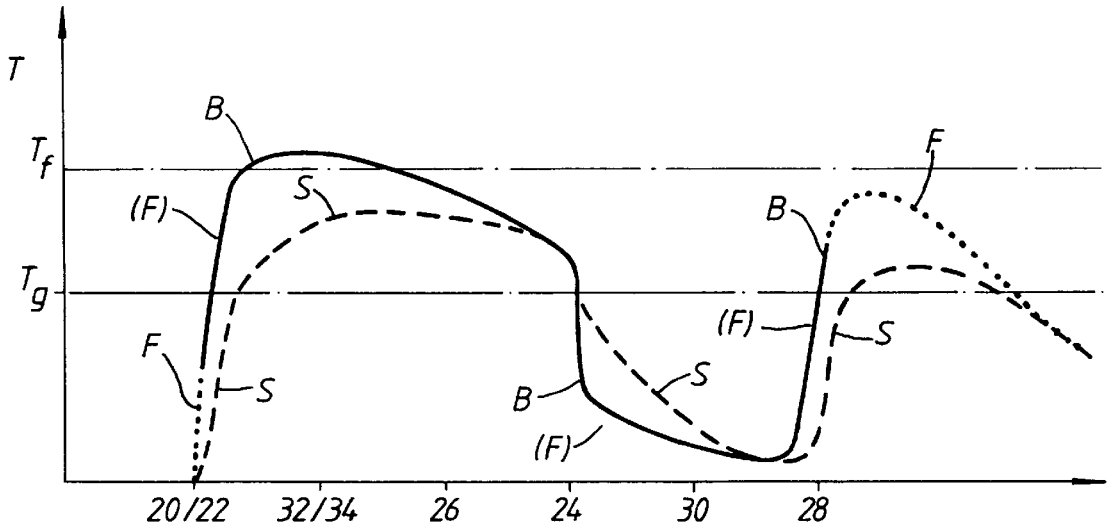
Figure 3:
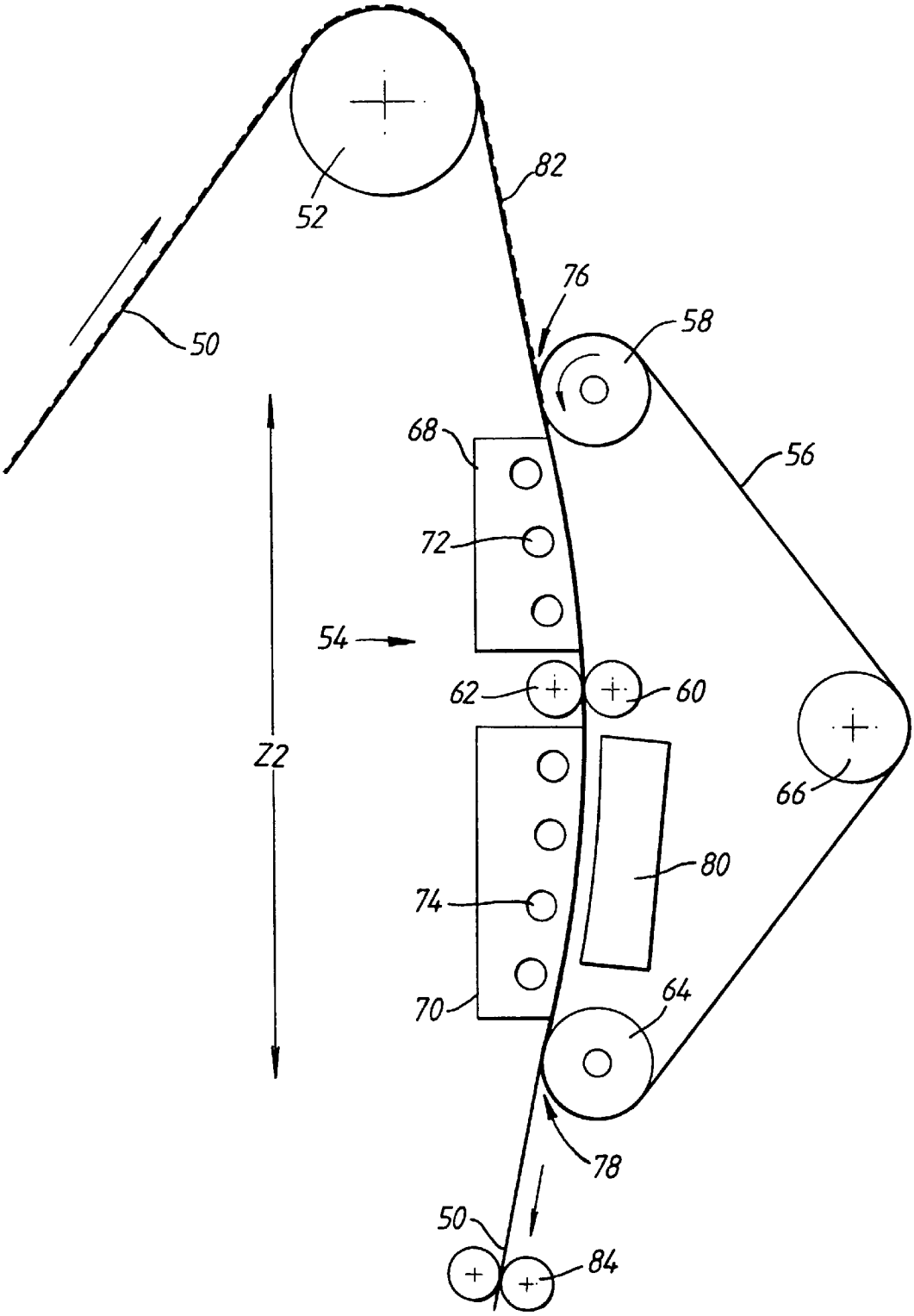
FIG. 3 shows an alternative embodiment according to the invention, for fixing toner images carried on one face of a substrate in the form of adhesive labels carried on a plastics material backing web.

FIGS. 1 to 3 illustrate the principle of a device for simultaneously fixing a toner image on a substrate and providing the image with the desired gloss, as applied to a substrate already carrying an unfixed toner image.

Referring to FIG. 1, the device 10 comprises a first belt 12, and a second belt 14 which constitutes a reaction surface in face-to-face pressure contact with the first belt to form an extended contact zone Z1 therebetween, thereby to define a substrate path extending through the contact zone from an entrance 16 to an exit 18. Each belt is impermeable, comprising a 70 $\mu$m metal backing carrying a 30 $\mu$m coating of non-adhesive silicone material such as DOW 200 series (ex Dow Corning Corporation).

The first belt 12 passes over, and is in contact with, a hard metal heated roller 20 which directly heats the first belt adjacent the entrance 16. Similarly, the second belt 14 passes over a heated roller 22 which directly heats the second belt 14 adjacent the entrance 16.

Each belt 12, 14 also passes over, and is in contact with, a respective resilient cooling roller 24, 26 which directly cools the respective belt intermediate the entrance and the exit of the contact zone Z1 to a temperature below the glass transition point $T_g$ of the toner. The cooling rollers 24, 26 are so positioned as to ensure more than tangential contact between each cooling roller 24, 26 and its associated belt. Thus each belt 12, 14 partially wraps around its associated cooling roller 24, 26 to increase the forcible cooling effect achieved thereby to a temperature below the glass transition point $T_g$ of the toner.

Each belt 12, 14 also passes over a respective second heated roller 28, 30 which heats the belt adjacent the exit 18 of the contact zone Z1 to a temperature at least 10° C. above the glass transition point $T_g$ of the toner.

A pair of intermediate pressure rollers 32, 34, exerting a pressure of, say, 7.5 N/cm$^2$, are located one on either side of the extended contact zone Z1, upstream of the cooling rollers 24, 26.

Each belt 12, 14 also passes over a respective tensioning and alignment roller 36, 38, the position of which is adjustable, by operation of means not shown, well known to those skilled in the art, to ensure adequate tension in the belts and to ensure their correct alignment.

The device shown in FIG. 1 operates as follows. Substrate in the form of a paper web 40, leaves an electrostatographic printing or copying machine (not shown) carrying unfixed multi-color toner particle images 42 on both faces. The images are formed of toners having a composition in powder form, comprising, for example, a thermoplastic binder and about 22% by weight, based on the weight of the toner composition, of an appropriately colored pigment, such as cyan, magenta, yellow and black, the composition having a weight average particle size of about 2 $\mu$m. The substrate is fed by a pair of downstream drive rollers 44 along the substrate path between the first and second belts 12, 14 from the entrance 16 to the outlet end 18 of the extended contact zone. The substrate is fed at a speed such as to spend from 5 to 10 seconds in the contact zone. The unit is driven by the paper web. A drive connected to the second heated roller 28 is driven in torque to compensate for mechanical losses. The belts 12, 14 are heated by the heating rollers 20, 22 adjacent the entrance 16 to 160° C., where the viscosities of the toners are between 10 and 40 Pa s. The belts 12, 14 are forcibly cooled by the cooling rollers 24, 26 intermediate the entrance and the exit to 50° C., which is below the glass transition point $T_g$ of the toner. The toner images 42 on the substrate thereby become fixed to the substrate, and their appearance is rendered glossy, with high color saturation. The second heated rollers 28, 30 heat the belts to 70° C., to ease the release of the toner from the belt.

In FIG. 2, there are shown charts plotting pressure and temperature against the position of the substrate in the device according to FIG. 1. Both plots indicate position along their horizontal axes, by using the reference numbers used in FIG. 1.

Referring to the chart of FIG. 2*a*, it will be seen that the pressure P to which the substrate is subjected rises as the substrate enters the contact zone, with the heated roller 20 at the entrance thereof. Pressure then falls back to an intermediate value $P_c$ which represents the contact pressure between the first and second belts. Pressure peaks again as the substrate passes between the intermediate pressure rollers 32, 34, with small peaks occurring as the substrate passes the cooling rollers 26 and 24 and the second heated rollers 30 and 28. Thereafter the pressure falls to zero as the substrate leaves the contact zone.

Referring to the chart of FIG. 2*b*, the temperature T of the belt 12 is indicated by a continuous line B. The temperature of the toner on that face of the substrate which is towards the cooling rollers 20, 32, 24 and 28 is indicated by a dotted line F. The temperature of the body of the substrate itself is indicated by a broken line S.

While the substrate is in the contact zone, the temperature of the toner closely follows that of the belt, since it has such a relatively small thermal capacity. It will be seen that the temperature of the toner rises sharply as the substrate enters the contact zone at the entrance of which the first heating rollers 20, 22 are located, the temperature of the toner exceeding the fluid temperature $T_f$ thereof. The toner particles are now fluid enough to migrate into the body of the substrate and to be flattened by application of the pressure between the belts leading to the desired fixing and glossing effects. At this high temperature, moisture is driven out of the substrate, but is unable to escape due to the impermeable nature of the belts. The temperature of the body of the substrate rises less rapidly, the toner being located on the surface of the substrate, but gradually heat is transferred from the toner and the belts to the body of the substrate as the substrate progresses through the contact zone. An equilibrium position, where the temperature of the toner and the body of the substrate are identical, may be reached as unforced cooling of both slowly occurs. As the substrate reaches the cooling roller 24, the temperature of the toner, following the temperature of the belt, drops rapidly to a level below the glass transition temperature $T_g$, with the temperature of the body of the substrate somewhat lagging behind. This hardens the toner in its fixed and flattened state. This cooling causes the moisture which had been driven out of the substrate to be condensed on the surfaces of the belts, now at a lower temperature than the substrate body. At the exit to the contact zone, where the second heated rollers 30, 28 are located, the temperature of the toner, still following the temperature of the belt, increases to a level above the glass transition temperature $T_g$, but not above the fluid temperature $T_f$, with the temperature of the body of the substrate lagging behind. The temperature difference between the toner and the body of the substrate is important at this point. If the temperature of the body of the substrate were to be above $T_g$ as the substrate separates from the belt 12, there would be a risk of the bond between the toner particles and the substrate breaking, resulting in the deposition of toner on the belt, i.e. resulting in offset. As it is, the weakest bond is between the toner particles and the belt and it is therefore here that the break occurs, thereby avoiding problems of offset. Furthermore, this second heating drives the moisture which had been condensed on the surfaces of the belts back into the substrate, so that overall substantially no moisture is lost from the substrate.

In the alternative embodiment of FIG. 3, the web 50 of a substrate in the form of adhesive labels carried on a plastics material backing web passes over a guide roller 52 before entering the fixing device 54. In this fixing device a single belt 56 passes over a heated roller 58, between a pair of intermediate pressure rollers 60, 62, exerting a pressure of, say, 7.5 N/cm$^2$, over a second heated roller 64 and a tensioning and alignment roller 66. The belt 56 is impermeable, comprising a 70 $\mu$m metal backing carrying a 30 $\mu$m coating of non-adhesive silicone material such as DOW200 series (ex Dow Corning Corporation). In this embodiment, the reaction surface is constituted by the surfaces of two stationary bodies 68, 70, which include passages 72, 74 therethrough for the passage of cooling fluids. The contact of the belt 56 with the stationary bodies 68, 70 defines a contact zone Z2, having an entrance 76 and an exit 78. Downstream of the intermediate pressure rollers 60, 62, there is provided a cooling box 80 which directs cold air against the belt 56 intermediate the entrance and the exit of the contact zone Z2 to cool the belt 56 to a temperature below the glass transition point $T_g$ of the toner.

The device shown in FIG. 3 operates as follows. The substrate leaves an electrostatographic printing or copying machine (not shown) carrying unfixed multi-color toner particle image 82 on the outer face of the labels. The substrate is fed along the substrate path by a downstream pair of drive rollers 84 from the entrance 76 to the exit 78 of the extended contact zone Z2. The stationary bodies 68,70 are cooled to 90° C. and 50° C. respectively, while the belt 56 is heated by the heating roller 58 adjacent the entrance 76 to 160° C., where the viscosity of the toner is between 10 and 40 Pa s. The belt 56 is cooled by the cooling box 80 intermediate the entrance and the exit to 50° C., which is below the glass transition point $T_g$ of the toner. The second heated roller 64 heats the belt 56 to 70° C., to ease the release of the toner from the belt. The toner images 82 on the substrate thereby become fixed to the substrate, and their appearance is rendered glossy, with high color saturation, while no offset on the belt 56 is found. The plastics material backing of the substrate 50 is cooled by passing over the cooling bodies 68, 70, to reduce the possibility of distortion occurring therein.

The present invention provides a number of advantages compared with known devices:

(i) the consumption of toner powder may be reduced;

(ii) the moisture content of the substrate is retained;

(iii) where the substrate is a transparent material, such as an over-head projector sheet, the contrast of the image is improved;

(iv) gloss can be deeper than can be achieved with known devices, because the first roller can be very hot;

(v) there are no additional consumables; and (vi) better coverage of the substrate by the toner particles leads to the possibility of a greater range of hues obtainable from combinations of toners of different colors, since the color of the substrate itself plays a less important role to the spectral character of the image.

We claim:

1. A method of fixing an unfixed toner particle image on a substrate, comprising:

feeding a substrate carrying an unfixed toner image through a contact zone which extends continuously from an entrance to an exit thereof and is defined by an endless surface and a reaction surface in face-to-face pressure contact with said endless surface, said toner having a glass transition point above room temperature and a viscosity at room temperature of at least 50 Pa s;

heating said endless surface adjacent said entrance to a temperature above said glass transition point sufficient to reduce said viscosity to less than 50 Pa s; and forcibly cooling said endless surface intermediate said entrance and said exit to a temperature below said glass transition point.

2. The method according to claim 1, further comprising applying pressure between said endless surface and said reaction surface intermediate said entrance and said exit.

3. The method according to claim 1, further comprising heating said endless surface adjacent said exit of said contact zone to a temperature above said glass transition point.

4. The method according to claim 1, wherein loss of moisture in said substrate is reduced by use of an impermeable endless surface and an impermeable reaction surface.

5. The method according to claim 1, wherein said toner image is formed of toner having a composition comprising a thermoplastic binder and from 10% to 50% by weight of a pigment, by weight of said toner composition.

6. The method according to claim 1, wherein said toner image is formed of a toner composition in powder form, having a weight average particle size of between 0.5 $\mu$m and 5 $\mu$m.

7. The method according to claim 1, further comprising:

applying pressure between said endless surface and said reaction surface intermediate said entrance and said exit; and heating said endless surface adjacent said exit of said contact zone to a temperature above said glass transition point.

8. A device for fixing an unfixed toner particle image on a substrate, comprising:

an endless surface;

a reaction surface in face-to-face pressure contact with said endless surface to form a contact zone therebetween, extending continuously from an entrance to an exit;

means for feeding a substrate carrying an unfixed toner image through said contact zone from said entrance to said exit, said toner having a glass transition point above room temperature and a viscosity at room temperature of at least 50 Pa s;

heating means for heating said endless surface adjacent said entrance, said heating means being capable of heating said endless surface adjacent said entrance to a temperature sufficient to reduce said viscosity to less than 50 Pa s;

cooling means for forcibly cooling said endless surface intermediate said entrance and said exit to a temperature below said glass transition point; and means for applying pressure between said endless surface and said reaction surface intermediate said entrance and exit.

9. The device according to claim 8, wherein said cooling means is constituted by a cooling roller so positioned as to ensure more than tangential contact between said cooling roller and said endless surface.

10. The device according to claim 8, wherein said reaction surface is constituted by a further endless surface and wherein said further endless surface is provided with further heating means for heating said further endless surface adjacent said entrance to a temperature sufficient to reduce said viscosity to less than 50 Pa s, and further cooling means for forcibly cooling said further endless surface intermediate said entrance and said exit to a temperature below said glass transition point.

11. A device for fixing an unfixed toner particle image on a substrate, comprising an endless surface, a reaction surface in face-to-face pressure contact with said endless surface to form a contact zone therebetween, extending continuously from an entrance to an exit, said toner having a glass transition point above room temperature and a viscosity at room temperature of at least 50 Pa s, means for feeding a substrate carrying an unfixed toner image through said contact zone from said entrance to said exit, heating means for heating said endless surface adjacent said entrance, said heating means being capable of heating said endless surface adjacent said entrance to a temperature sufficient to reduce said viscosity to less than 50 Pa s, cooling means for forcibly cooling said endless surface intermediate said entrance and said exit to a temperature below said glass transition point, and second heating means for heating said endless surface adjacent said exit to a temperature above said glass transition point.

12. The device according to claim 11, wherein said cooling means is constituted by a cooling roller so positioned as to ensure more than tangential contact between said cooling roller and said endless surface.

13. The device according to claims 11, wherein said reaction surface is constituted by a further endless surface and wherein said further endless surface is provided with further heating means for heating said further endless surface adjacent said entrance to a temperature sufficient to reduce said viscosity to less than 50 Pa s, and further cooling means for forcibly cooling said further endless surface intermediate said entrance and said exit to a temperature below said glass transition point.

* * * * *

UNITED STATES PATENT AND TRADEMARK OFFICE

CERTIFICATE OF CORRECTION

PATENT NO. : 5,970,301

DATED : October 19, 1999

INVENTOR(S) : Etienne Marie De Cock

It is certified that error appears in the above-identified patent and that said Letters Patent is hereby corrected as shown below:

Title Page, Item [54], Title: "METHOD FIXING" should read -- METHOD FOR FIXING --;

Column 1, line 2: "METHOD FIXING" should read -- METHOD FOR FIXING --;

Column 1, line 5: "60/067664" should read -- 60/067,664 --.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*